United States Patent [19]

Rogers

[11] 4,021,850

[45] May 3, 1977

[54] COLOR TELEVISION PICTURE TUBES WITH IMPROVED IMPLOSION PROTECTION SYSTEM

[75] Inventor: Melvin F. Rogers, Western Springs, Ill.

[73] Assignee: Zenith Radio Corporation, Glenview, Ill.

[22] Filed: Oct. 20, 1975

[21] Appl. No.: 623,854

[52] U.S. Cl. ..... 358/245; 358/246; 358/247; 220/2.1 A; 220/2.3 A; 313/477 R

[51] Int. Cl.² ..... H01J 31/00

[58] Field of Search ..... 178/7.8, 7.82; 220/2.1 A, 2.3 A; 313/477; 358/245, 246, 247

[56] References Cited

UNITED STATES PATENTS

| | | | |
|---|---|---|---|
| 2,222,197 | 11/1940 | Engels | 313/477 X |
| 2,697,311 | 12/1954 | Polan | 220/2.1 X |
| 3,220,592 | 11/1965 | Powell et al. | 220/2.1 |

*Primary Examiner*—Robert L. Richardson
*Assistant Examiner*—Edward L. Coles
*Attorney, Agent, or Firm*—John R. Garrett

[57] ABSTRACT

This disclosure depicts a novel system for implosion protecting a color television picture tube having a faceplate with a rearwardly extending side surface and a mating funnel. The system is illustrated as comprising, in part, a high tensile strength frame which surrounds and overlies at least a portion of the side surface of the faceplate and which is cemented to the faceplate. The system further comprises a crack retarder which is located about the circumference of the tube, but which is spaced axially rearwardly from the frame. The system assists in retaining in position the shards of a shattered faceplate and also assists in retarding the propagation of cracks in the tube, thereby providing for a relatively gradual buildup of pressure in the tube.

8 Claims, 3 Drawing Figures

COLOR TELEVISION PICTURE TUBES WITH IMPROVED IMPLOSION PROTECTION SYSTEM

CROSS REFERENCE TO RELATED APPLICATIONS

This application relates to, but is in no way dependent upon, copending applications of common ownership herewith, including: p Ser. No. 623,853, filed Oct. 20, 1975 623,852, filed Oct. 20, 1975; Ser. No. 639,741, filed Dec. 11, 1975; Ser. No. 714,055, filed Aug. 13, 1975 Ser. No. 632,559, filed Nov. 17, 1975.

BACKGROUND OF THE INVENTION

This invention relates in general to color television picture tubes and in particular, to a system for implosion protecting such tubes. Conventionally, a color television picture tube has a glass bulb including a funnel, a flanged faceplate sealed to the flared end of the funnel, and an electron gun assembly mounted in the funnel neck for providing a source of cathode rays. The faceplate has a concave inner surface on which is deposited an electron-excitable phosphor screen. After the faceplate is sealed to the funnel, the glass bulb is evacuated and, as a result, several tons of atmospheric pressure is exerted against the external surface of the faceplate. A glass bulb of this type is subject to implosion. The term "implosion" is defined by Underwriters Laboratory Incorporated as "rapid and sudden inward bursting of a high-vacuum glass envelope." It is of the utmost importance in the interest of safety to prevent the faceplate from violently shattering should it be struck for example, by a heavy missile, for when a bulb implodes fragments of glass may fly forwardly from the tube into the viewing area.

Three basic approaches for implosion protection color cathode ray tubes (CRT's) have evolved. These three approached employ different principles of operation. One approach is implemented in systems referred to as "rimbond" systems. The rimbond system has a scalloped metal frame which surrounds the flange found on every conventional faceplate. The gap between the frame and the faceplate flange is filled with a cement— typically an epoxy cement. In a rimbond system, the frame is not under tension. The cement holds in position the pieces of glass of a shattered faceplate long enough for air to enter the tube through the cracks formed so that pressure builds up in the tube relatively slowly. This prevents unacceptable amounts of glass from being projected forwardly from the tube, although the tube may still collapse. Patents illustrating such rimbond systems are U.S. Pat. Nos. 3,485,407; 3,558,818; 3,412,203 and 3,835,250. A major drawback to such rimbond systems has been the large amounts of very costly epoxy cement needed to adhere the metal frame to the faceplate.

A second basic implosion protection approach is termed the "tension band" approach. Systems implementing this approach comprise a strap or band which is placed around the faceplate flange and put under very high tensile force. Numerous patents have been issued on various aspects of tension band systems. See U.S. Pat. Nos. 3,818,557; 3,777,057; 3,845,530; and 3,890,464. The tension band systems, however, also have several drawbacks. When the tension band is tightened about the faceplate flange, it is very likely that the glass will be scratched as the band moves across it during the tightening process. This creates flaws at the location of the scratches, increasing the possibility of cracks forming there during implosion. Also, the distribution of forces applied to the faceplate flange by the band is irregular. Specifically, the forces applied at the corners by the band are much greater than the forces applied at the sides of the faceplate flange.

The third approach is to bond a transparent protective shield over the front surface of the faceplate. Systems following this approach are commonly termed "bonded panel" systems. The bonded panel systems have no pertinence to this invention and therefore will be discussed further.

A U.S. Pat. No. 2,222,197 to Braun discloses a CRT in which the CRT envelope comprises a curved flangeless faceplate inset in an expanded open end of a cooperating funnel. A band allegedly providing implosion protection surrounds the funnel near the open end thereof in a plane intersecting the faceplate which is ensconsed withing the funnel mouth. The Braun system is quite different from the present system. No frame of any sort is provided. The implosion band environs the funnel rather than a rearwardly extending surface on the faceplate. No webbing material is employed. A comparison of the Braun system and the present system will reveal other important differences, also.

An implosion protecton system is disclosed in U.S. Pat. No. 3,220,593 by D. E. Powell et al, in which a webbing material is glued to a substantial portion of the funnel and to the flange of a standard flanged faceplate and in which a tension band is applied around the flange of the faceplate and over the webbing material. Systems such as this have apparently not met the rigid test of commercial use; to my knowledge, no such system has found a practical application in the color television picture tube market. Other patents disclosing the use of a webbing material in an implosion protection system for a color CRT are U.S. Pat. Nos. 3,206,056 and 3,314,566.

This invention is applicable to both a conventional tube with a deep flanged faceplate and a unique tube having a flangeless faceplate. This unique tube is disclosed in U.S. Pat. No. 3,894,260, issued to the assignee of this application. That tube has a flangeless, curved glass faceplate, a concave inner surface of which receives a phosphor screen. The funnel portion of this unique tube has a convex seal land which matches in curvature and mates with the concave inner surface of the faceplate.

OBJECTS OF THE INVENTION

It is an object of the present invention to provide for a color television picture tube an improved system for implosion protection.

It is another object of the present invention to provide an effective and low cost implosion protection system for a novel color television picture tube having a flangeless faceplate.

It is an object of the present invention to provide for a color television picture tube of the conventional type having a flanged faceplate, an implosion protection system which is effective, yet of comparatively low cost.

DESCRIPTION OF THE PREFERRED EMBODIMENT

This invention is applicable to both a conventional television picture tube and a unique television picture tube disclosed in U.S. Pat. No. 3,894,260, issued to the assignee of this application. The faceplate of the conventional tube has a deep flange which extends rearwardly from a front surface, whereas in the unique tube no such flange exists. The side surface of the faceplate which extends rearwardly from its front surface is in actuality the thickness of the faceplate. This unique tube will now be described in more detail.

Figure 1:
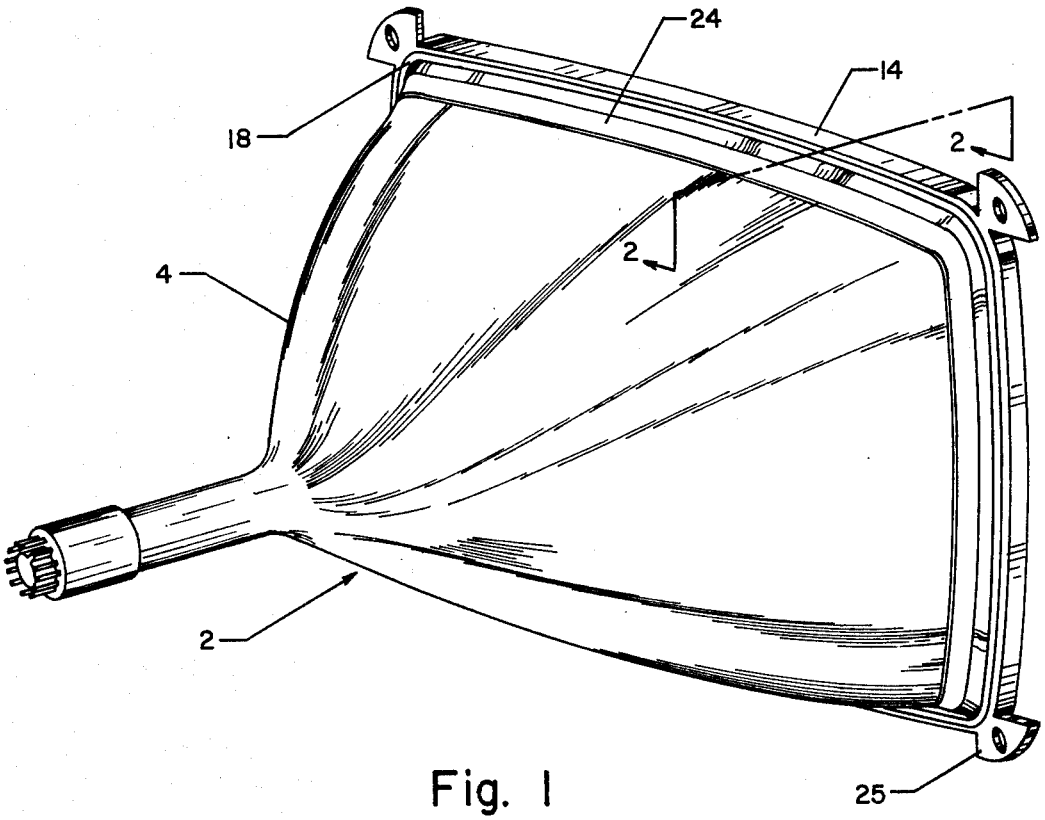
FIG. 1 is a perspective view of a unique color cathode ray tube embodying the present invention.
Figure 2:
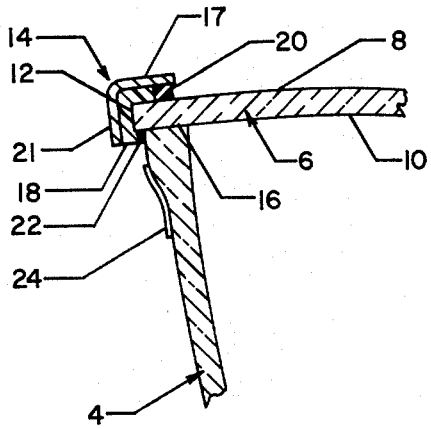
FIG. 2 is an enlarged schematic fragmentary side section view of the FIG. 1 tube.

The unique tube 2, as illustrated in FIG. 1 and FIG. 2, has an envelope comprising a funnel 4 sealed to a flangeless faceplate 6. The construction of the faceplate 6 without a flange permits economies in manufacture of the envelope and simplified and economical screening and assembly processes. The faceplate 6 has a curved configuration which may be spherical, multi-radial, cylindrical, or of other suitable curvature. The faceplate 6 has a convex front surface 8 connected to a concave rear surface 10 by a peripheral edge surface 12. The edge surface 12 is contoured, that is, the edge surface portions along sides of the faceplate depart from and return to a plane connecting the four corners of the faceplate.

The funnel 4 has a convex seal land, herein intended to mean a seal land which lies on an imaginary curved surface, which surface curvature may be spherical, multi-radial, cylindrical, or of other suitable curved configuration. The seal land of the funnel 4 is curved to match and mate with the concave rear surface 10 of the faceplate 6 along a sealing interface 16. The seal land of the funnel 4 is hermetically bonded to the rear surface 10 of the faceplate 6 by a devitrifying glass solder, herein termed a "frit material" 11.

The concave rear surface 10 of the faceplate 6 is here shown as being slightly larger than the wide end of the funnel 4 to which the faceplate 6 is attached. Thus, when the tube 2 is assembled, the faceplate overhangs the funnel slightly. Alternatively, the faceplate edge surface 12 may be flush with the outside surface of the funnel 4.

Figure 3:
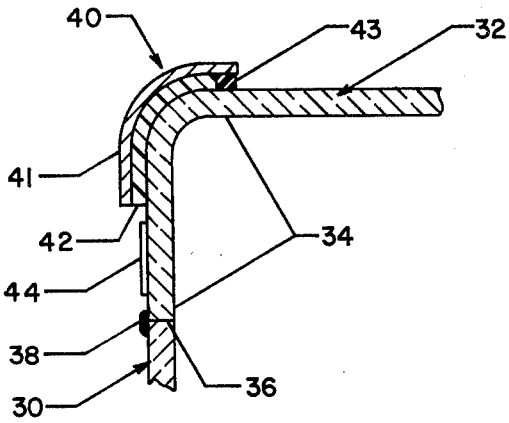
FIG. 3 is a schematic fragmentary side view of a conventional color cathode ray tube embodying the present invention.

A conventional tube is shown in a fragmentary sectional side view in FIG. 3. The faceplate 32 has a deep rearwardly extending flange 34 which mates with a funnel 30 at a sealing interface 36. The faceplate 32 and funnel 30 are hermetically bonded together by a frit material 38.

A novel hybrid implosion protection system constructed according to this invention for a conventional tube or a flangeless faceplate tube as described above is illustrated in FIGS. 1–3. As described, relevant prior art systems used on conventional flanged faceplate tubes followed either of two approaches: (1) the "rimbond" approach wherein a portion of the outside surface of the faceplate flange is cemented to a surrounding variable depth frame; and (2) the "tension band" approach wherein the flange is compressed tightly by a high tension band. This invention involves a unique hybrid approach to implosion protection. In the preferred embodiments, in the interest of minimizing costs, the frame around the tube, preferably shallow, is cemented to the bulb. In addition to the frame, a narrow webbing material, such as a fiberglass fabric, is bonded to the tube. The webbing material is located about the tube's circumference, axially rearwardly from the frame. This webbing material tends to retard the propagation of cracks in the tube when the faceplate is shattered, and thus assists in prolonging the time elapsed to devacuate a bulb. The webbing material is hereafter referred to as a "crack retarder."

The hybrid implosion protection system used on the unique color television picture tube described above and illustrated in FIGS. 1 and 2 comprises a crack retarder and an edgebond structure. A similar edgebond structure, per se, is disclosed and claimed in my above referenced co-pending application Ser. No. 623,853, filed Oct. 20, 1975. This edgebond structure will now be described in detail. Referring to FIG. 2, a high tensile strength frame 14 surrounds and overlies the peripheral edge surface 12 of the faceplate 6. The frame 14 has a contour corresponding generally to that of the edge surface 12 of the faceplate 6. That is, a contour in which the sides of the frame 14 depart from and return to a plane connecting the four corners of the frame 14. The direction of departure of the frame 14 from the plane is the same as the direction of departure of the sides of the faceplate edge surface 12 from a plane connecting the four corners of the faceplate 6.

The addition of the crack retarder to the edgebond structure greatly increases the implosion protection for the color television picture tube. As the name implies, the crack retarder slows the propagation of cracks through the glass tube 2 when the faceplate 6 is shattered.

This invention, in an alternative embodiment illustrated in FIG. 3, may be applied to a conventional color television picture tube. In effect, the hybrid implosion protection system for this embodiment comprises a rimbond structure and a crack retarder. In the rimbond structure, a high tensile strength scalloped frame 40 surrounds and overlies the flange portion 34 of the faceplate 32 so that the front-to-back depth of the frame 40 increases to a maximum at the center of the sides of the faceplate 32. A cement 42 bonds the frame 40 to the flanged portion 34 of the faceplate 32. In this embodiment, the other element of the hybrid implosion protection system, the crack retarder 44, is also bonded to the flanged portion 34 of the faceplate 32. Again, it should be noted that the crack retarder is spaced axially rearwardly from the frame 40. Alternatively, the crack retarder could be located on the funnel 30 or on both the funnel 30 and the flanged portion 34 of the faceplate 32 covering the frit material 38 and sealing interface 36.

In both embodiments of the hybrid implosion protectin system on the conventional television tube and the novel tube, the frame according to this invention offers economy not only in frame cost, but more importantly in the amount of costly cement required to bond the frame to the tube. Also, the use of much less material in the crack retarder offers additional savings in cost. Conventional crack retarders, as disclosed for example in U.S. Pat. No. 3,220,592 and U.S. Pat. No. 3,220,593, comprise a flexible material glued to a substantial portion of the funnel and the flange of the faceplate. This type of crack retarder is commercially impractical due to the large amount of material needed. Although not necessary, it is preferable also that the frame have a lip which overlies a small portion of the front surface of the faceplate.

The assembly of the system is the same for both types of tubes illustrated in FIGS. 2 & 3; however, for illustrative purposes, the tube illustrated in FIG. 2 will be discussed. To assemble the system, the frame 14 is placed in correct position with respect to the faceplate 6 and a cement 18, preferably an epoxy cement, is introduced into the gap between the frame 14 and the edge surface 12 of the faceplate 6. A gasket 20 disposed between the lip 17 and the marginal portion 15 of the surface 8 prevents the cement 18 from flowing onto the convex front surface 8 of the faceplate 6; other sutable ethods also may be used to prevent the cement 18 from flowing onto the front surface 8.

As illustrated in FIG. 1, mounting tabs 25 for attaching the tube 2 to a cabinet may be included as part of the frame 14. In the preferred embodiment the tabs 25 extend from the corners of the frame 14 and have provisions, such as holes, for permitting attachment of the tube to the cabinet. Alternatively, these tabs could be placed anywhere about the frame or formed in a way which would best suit the type of cabinet being used.

An important aspect of the edgebond structure is that the frame 14 and the frame-contained cement 18, embrace and bind up the entire edge surface 12 of the faceplate 6. It is desirable that the cement cover the sealing interface for two reasons, (1) the implosion protection afforded by the system is improved, (2) the epoxy cement being a good electrical insulator, insulates the sealing interface and obviates the customary wrapping of the sealing interface with insulative tape.

In effect, the edgebond structure embraces and binds up the actual thickness dimensions of the faceplate 6, thereby effectively holding together the pieces of the faceplate when it is shattered long enough to allow air to enter the tube 2 slowly. The internal pressure on the tube is thus caused to inrease gradually, preventing unacceptable amounts of glass fragments from being thrown forwardly from the shattered tube. The crack retarder 24 of the hybrid implosion protection system, is a narrow webbing material bonded to the funnel 4 of the tube 2. The crack retarder 24 is located about the circumference of the funnel in close proximity to the frame 14, but being spaced axially rearwardly from the frame 14.

The crack retarder 24 is wrapped around the tube preferably once only in its correct location and is bonded to the tube by an epoxy impregnated in the webbing material of the crack retarder 24. Alternatively, the crack retarder 24 may have the epoxy applied to it after it is wrapped around the tube. As was previously stated, this procedure also applies to the conventional tube illustrated in FIG. 3.

Underwirters Laboratories Incorporated ("UL") sets the standards for implosion protected cathode ray tubes for televison receiving equipment. The test employed by UL is generally as follows: The color television picture tube is mounted in a test cabinet enclosure of a specified size (depends on the size of the tube). The cabinet is supported on a 30 inches high, rigid, table-like test stand. Two barriers each ½ inch thick, 9 ½ inches high and 72 inches long are placed on edge on the floor in front of the test stand. The barriers are located at distances of 3 ft. and 5 ft., respectively, from the plane of the front enclosure of the cabinet. The three areas bounded by the barriers are indicated as follows: Zone 1: 0–3 ft., Zone 2: 3–5 ft., Zone 3: 5 ft. and beyond. The ball impact test is defined as follows. An impact is to be applied to any point on the face of the tube ½ inch away from the edge of the screen area and is to be obtained from a solid, smooth, steel sphere 2 inches in diameter and weighing approximately 1.18 lbs. The sphere is to be suspended by a sutable cord and allowed to fall freely as a pendulum from rest through a distance necessary to cause it to strike the tube face with an impact of 5 foot-pounds. The cabinet supporting the cathode ray tube is to be placed so that the surface tested is vertical and in the same vertical plane as the point of support of the pendulum. When a tube is tested as described above, the amount of glass thrown forward shall not exceed the following. First, there shall be no single piece of glass weighing more than ½ oz. in Zone 2; second, the total weight of all the pieces of glass in Zone 2 shall not exceed 1 ½ oz.; and third, there shall be no single piece of glass in Zone 3 weighing more than 0.05 oz.

A 23 inch diagonal tube of the character shown in FIGS. 1–2 has been constructed. From preliminary test results, it is expected that the tube will successfully pass the implosion protection tests of the Underwriters Laboratory Incorporated (described above). This tube had an implosion protection system comprised, in part, of an edgebond structure including a steel frame 14 with a thickness in the range 0.025 to 0.030 inch and a uniform depth of approximately ⅝ inch. The frame 14 had a lip 17 of approximately ¼ inch overlapping the front surface 8 of the faceplate 6. The gap between the frame 14 and the edge surface 12 of the faceplate 6 was about ⅛ inch, the edge surface 12 of the faceplate 6 having a width of 0.450 inch. A cement 18 (thixotropic epoxy, type A) was introduced into the gap so as to cover the sealing interface 16 as well as the marginal portion 15 of the front surface 8 of the faceplate 6. A gasket 20 of foam rubber tape approximately ⅛ inch thick was used with an adhesive for attaching it to the frame 14. A webbing material 24 of epoxy-impregnated fiberglass with a width in the range ¾ to 2 inches was used and positioned on the funnel approximately 1/16 to ¼ inch from the edgebond structure. Other materials, such as nylon, polyester, or cloth, can be used for the webbing material 24. The webbing material 24 was bonded to the funnel 4 with epoxy, although other cements could be used.

In another embodiment the invention was constructed using a 13 inch diagonal tube having a conventional flanged faceplate and comprised, in part, a rimbond structure including a steel frame 40 with a thickness in the range 0.025 to 0.030 inch and a corner depth of approximately ½ inch, a maximum side depth of about 1 inch and a lip 41, overlapping the front surface of the faceplate of, approximately ¼ inch. The gap between the frame 40 and the flange 34 was about 3/16 inch. A liquid type A epoxy was introduced into the gap and a gasket 43 of foam rubber tape approximately ⅛ inch thick was used with an adhesive for attaching it to the frame 14. A webbing material 44 of epoxy-impregnated fiberglass with a width of approximately 1 inch was used and positioned on the flange 34 approximately ¼ inch from the rimbond structure.

From preliminary tests, this latter tube is also expected to pass the afore-discussed UL test.

The invention is not limited to the particular details of construction of the device depicted and other modifications and applications are contemplated. For example, whereas one of the above-depicted embodiments included an approximately spherical or multi-radial faceplate, the invention may be applied to other types of tubes having a contoured faceplate edge surface and sealing interface — e.g. a tube having a flangeless cylindrical faceplate. Certain other changes may be made in the above-described device without departing from the true spirit and scope of the invention herein involved. It is intended therefore, that the subject matter in the above depiction shall be interpretative as illustrated and not in a limiting sense.

What is claimed is:

1. A color television picture tube having a glass bulb with an approximately rectangular, flangeless, curved faceplate having a convex front surface through which television pictures are viewed, a concave rear surface, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said tube including a hybrid implosion protection system comprising:

an edgebond structure for holding together glass fragment of a fractured faceplate, including:

a high tensile strength frame which surrounds said edge surface of said faceplate and which has a contour corresponding generally to that of said edge surface, i.e., a contour in which sides of the frame depart from and return to a plane connecting the four corners of the frame, the direction of said departure being the same as for the faceplate edge surface, and a cement between said frame and said edge surface of said faceplate, said frame and said cement binding up said edge surface of said faceplate; and a narrow strip crack retarder located about the circumference of said funnel and bonded thereto, said retarder being spaced axially rearwardly from said frame and in close adjacency thereto.

2. The combination defined by claim 1 wherein said crack retarder is a narrow strip of webbing material from ¾ to 2 inches wide bonded to said funnel with an adhesive material.

3. A color television picture tube having a glass bulb with an approximately rectangular, flangeless, curved faceplate having a convex front surface through which television pictures are viewed, a concave rear surface, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said tube including a hybrid implosion protection system comprising:

an edgebond structure for holding together glass fragments of a fractured faceplate, including:

a shallow, contoured, high tensile strength metal frame which surrounds said edge surface of said faceplate and which has a substantially uniform front-to-back depth, and a cement between said frame and said edge surface, said frame and said cement binding up said edge surface; and a narrow strip crack retarder located about the circumference of said funnel and bonded thereto, said retarder being spaced axially rearwardly from said frame and in close adjacency thereto.

4. The combination defined by claim 3 wherein said crack retarder is a narrow strip of webbing material from ¾ to 2 inches wide bonded to said funnel with an adhesive material.

5. A color television picture tube having a glass bulb with an approximately rectangular, flangeless, curved faceplate having a convex front surface through which television pictures are viewed, a concave rear surface, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel having a convex seal land which mates with the concave inner surface of the faceplate to define a contoured sealing interface, said tube including a hybrid implosion protection system comprising:

a structure for holding together glass fragments of a fractured faceplate, including:

a high tensile strength frame which surrounds said edge surface of said faceplate and which has a contour corresponding generally to that of said edge surface, i.e., a contour which sides of the frame depart from and return to a plane connecting the four corners of the frame, the direction of said departure being the same as for the faceplate edge surface, and an electrically insulative epoxy-type cement between said frame and said bulb, said frame and said cement embracing and binding up the entire edge surface of said faceplate, a small marginal portion of said convex front surface and said sealing interface, said cement also serving to electrically insulate said sealing interface; and a narrow strip crack retarder located about the circumference of funnel bulb and bonded thereto, said retarder being spaced axially rearwardly from said frame and in close adjacency thereto.

6. The combination defined by claim 5 wherein said crack retarder is a narrow strip of webbing material from ¾ to 2 inches wide bonded to said funnel with an adhesive material.

7. A color television picture tube having a glass bulb with an approximately rectangular, flangeless, three-dimensionally curved faceplate having a convex front surface through which television pictures are viewed, a concave rear surface, and a peripheral edge surface connecting the convex front surface and the concave rear surface of the faceplate, the peripheral edge surface being contoured, that is, having sides which depart from and return to a plane connecting the four corners of the faceplate, the glass bulb also having a funnel with a convex seal land which mates with the concave inner surface of the faceplate to define a sealing interface and which is sealed to said faceplate with a frit material, said tube including a hybrid implosion protection system comprising:

an edgebond structure for holding together glass fragments of a fractured faceplate including:

a shallow, contoured, high tensile strength metal frame which surrounds said edge surface of said faceplate and overlies a small marginal portion of said front surface of said faceplate, said frame having a depth which is substantially uniform and of sufficient magnitude to overlie said peripheral edge surface and said sealing interface of said faceplate, and an electrically insulative epoxy-type cement between said frame and said bulb which, together with said frame, embraces and binds up the entire edge surface, said sealing interface, and a small marginal portion of said convex front surface, said cement also serving to electrically insulate said sealing interface; and a narrow strip crack retarder located about the circumference of said funnel and bonded thereto, said retarder being spaced axially rearwardly from said frame and in close adjacency thereto.

8. The combination defined by claim 7 wherein said crack retarder is a narrow strip of webbing material from ¾ to 2 inches wide bonded to said funnel with an adhesive material.

* * * * *